US005765390A

United States Patent [19]

Johnson et al.

[11] Patent Number: 5,765,390

[45] Date of Patent: Jun. 16, 1998

[54] REFRIGERATOR DAIRY COMPARTMENT ASSEMBLY

[75] Inventors: Warren F. Johnson, Galesburg, Ill.; Todd J. Tunzi, Newton, Iowa

[73] Assignee: Maytag Corporation, Newton, Iowa

[21] Appl. No.: 854,888

[22] Filed: May 12, 1997

[51] Int. Cl.[6] ..... F25D 11/02

[52] U.S. Cl. ..... 62/441; 211/43; 312/405.1

[58] Field of Search ..... 62/441; 211/43, 211/184; 312/321.5, 404, 405.1, 408

[56] References Cited

U.S. PATENT DOCUMENTS

| | | | |
|---|---|---|---|
| 2,612,029 | 9/1952 | Schrader et al. . | |
| 2,706,140 | 4/1955 | Hinkel . | |
| 2,773,677 | 12/1956 | Hinkel . | |
| 2,783,030 | 2/1957 | Solley, Jr. . | |
| 2,808,310 | 10/1957 | Patterson, Jr. . | |
| 3,391,793 | 7/1968 | Streuli . | |
| 3,467,458 | 9/1969 | Simms et al. . | |
| 4,351,439 | 9/1982 | Taylor | 211/43 |
| 4,798,425 | 1/1989 | Armstrong et al. . | |
| 4,901,869 | 2/1990 | Hawkinson | 211/184 |
| 5,161,704 | 11/1992 | Valiulis . | |
| 5,193,892 | 3/1993 | Swindell . | |
| 5,445,452 | 8/1995 | Kauffman et al. | 312/321.5 |

*Primary Examiner*—William E. Tapolcoi
*Attorney, Agent, or Firm*—Everett G. Diederiks, Jr.

[57] ABSTRACT

A refrigerator door is provided with a dairy compartment defined, at least in part, by a first dairy compartment member and a second dairy compartment member. The first dairy compartment member is movably connected to an inner wall portion of the door and the second dairy compartment member is slidably attached to the first dairy compartment member. In accordance with a first embodiment of the invention, the first dairy compartment member is constituted by a dairy compartment cover that is pivotally connected to a pair of spaced dike portions formed integral with a liner of the door. In a second embodiment, the first dairy compartment member constitutes a dairy compartment defining shelf member or bucket that is selectively, removably attached to the dike portions. In each of the first and second embodiments, the second dairy compartment member constitutes an element which is slidably attached to the first dairy compartment member and divides the dairy compartment into varying volume storage zones.

20 Claims, 2 Drawing Sheets

FIG. 4
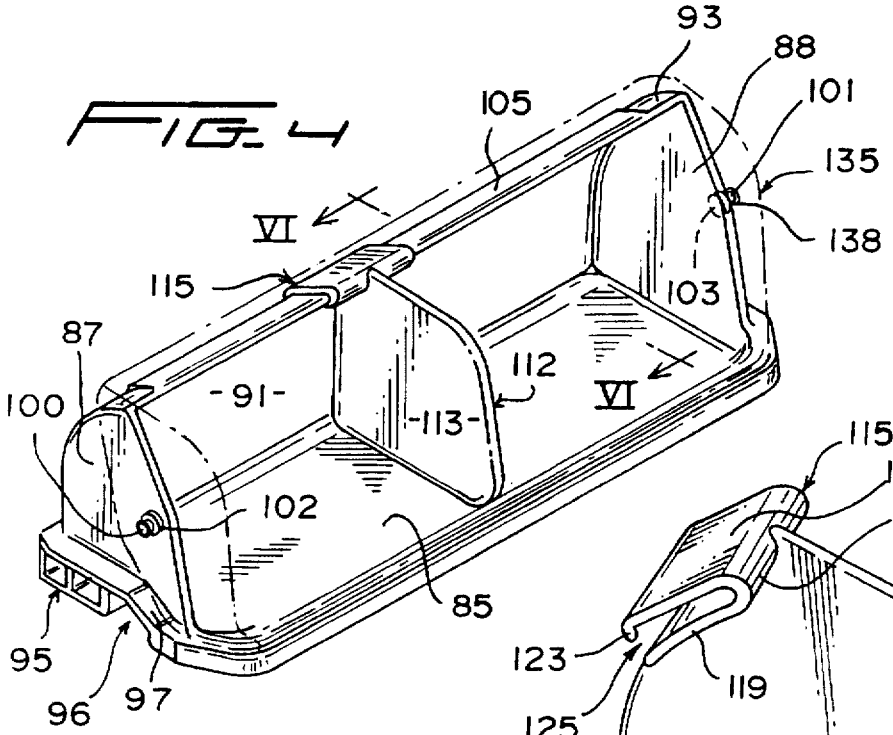
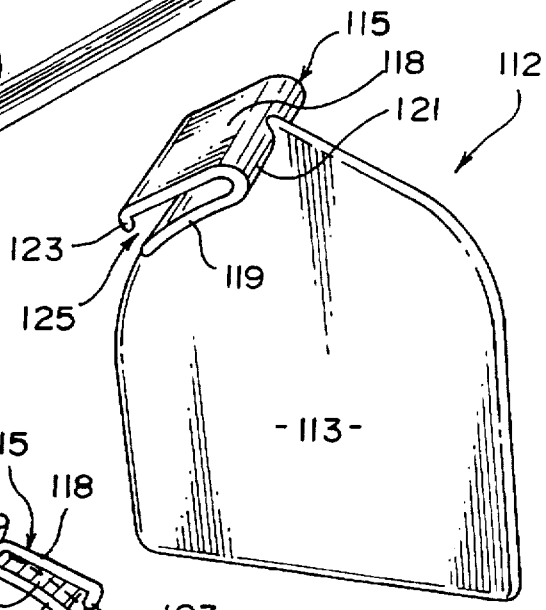
FIG. 5
FIG. 6
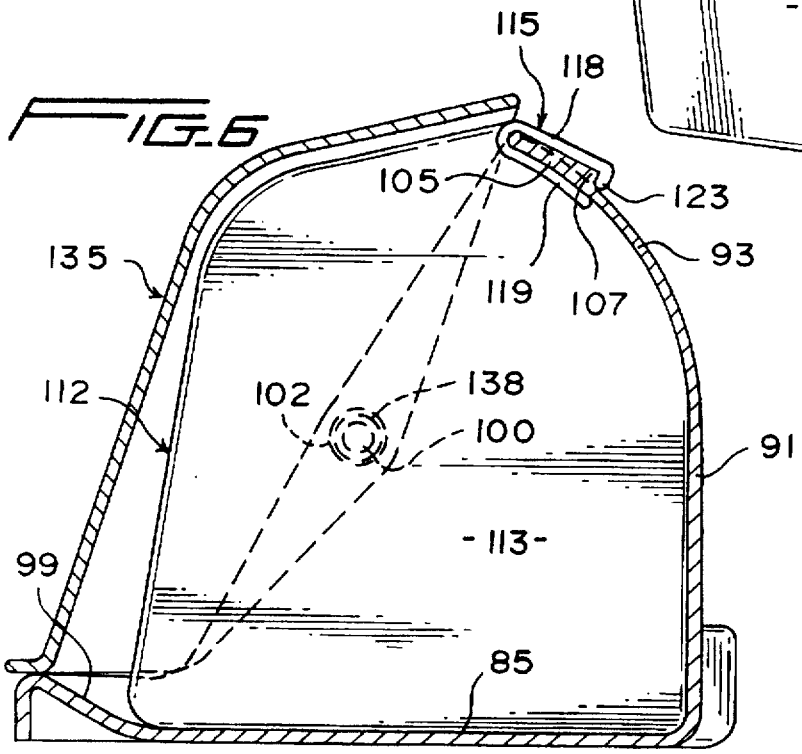

REFRIGERATOR DAIRY COMPARTMENT ASSEMBLY

BACKGROUND OF THE INVENTION

1. Field of the Invention

The present invention pertains to the art of refrigerators and, more particularly, to a dairy compartment assembly for use on the door of a refrigerator cabinet.

2. Discussion of the Prior Art

In the art of refrigerators, it is commonly known to incorporate various shelves and/or compartments on an inner fresh food compartment door for use in storing various food items. Generally, refrigerator fresh food compartment doors are formed from an outer metal shell to which is attached a plastic inner wall defining liner. It is known to integrally form such liners with shelf defining members, such as dike portions. For example, it is known in the art to provide a generally horizontally extending shelf with side walls defined by door dikes to support dairy items on the door. Often times, a closure member extends between the dikes and is pivotable between a dairy compartment access position and a closed position. The use of such a closure member is preferable to prevent items stored in the dairy compartment from becoming dislodged upon a sudden movement of the fresh food compartment door.

Unfortunately, items placed in such dairy compartments can be undesirably shifted upon movement of the door, regardless of the positioning of the closure member. Although the door liner could be integrally molded with various smaller compartments instead of a single, large dairy compartment in order to limit the permissible shifting of the food items, such an arrangement would limit the versatility of the compartment to hold items of varying sizes. In addition, the inclusion of additional dike portions simply occupies valuable space that could be used for storage purposes.

In addition to the above outlined problems, conventional dairy compartments on refrigerator doors have a predetermined size and often times cannot house large dairy products, such as margarine tubs commonly available in the marketplace. Furthermore, since the base and side walls of these known dairy compartments are formed integral with the liner, when multiple dairy products are to be removed from the compartment, they must be removed individually. Of course, removing various items in this fashion, as well as individually returning them to the dairy compartment, can be time consuming.

Based on the above, there exists a need in the art for a dairy compartment assembly which cannot only prevent items from falling out of the compartment upon sudden shifting of a refrigerator door, but which also can minimize lateral shifting of the items within the compartment. Furthermore, there exists a need for a versatile dairy compartment assembly that can retain items of varying sizes in a desired position within a dairy compartment. Furthermore, there exists a need in the art for a dairy compartment assembly that can accommodate rather large dairy items and which can enable numerous items to be removed from or replaced within a dairy compartment simultaneously.

SUMMARY OF THE INVENTION

The present invention pertains to a dairy compartment assembly provided on an inner wall portion of a fresh food refrigerator door, wherein the dairy compartment assembly includes a first dairy compartment member that is movably connected to the inner wall portion of the door and a second dairy compartment member that is slidably attached to the first dairy compartment member. The second dairy compartment member actually defines a divider element for separating the dairy compartment into varying volume storage zones.

In accordance with a first embodiment of the invention, the first dairy compartment member constitutes a closure member or cover that is pivotally connected to laterally spaced dike portions of the door. In addition, the second dairy compartment member defines a divider plate formed with an elongated socket defining member that is snap-fit unto an elongated knob portion formed at an upper rear end of the first dairy compartment member. With this arrangement, the second dairy compartment member is permitted to slide laterally relative to both the inner wall of the door and the first dairy compartment member, while also pivoting simultaneously with the first dairy compartment member.

In accordance with a second embodiment of the invention, the first dairy compartment member is defined by a pick-off shelf member or bucket that is sized to accommodate large dairy food items and which is readily removably attached to the laterally spaced dike portions of the refrigerator door. In this embodiment, the second dairy compartment member also constitutes a divider plate having a socket member that snap-fittingly receives an upper edge section of a top wall portion of the pick-off shelf. This interconnection enables the second dairy compartment member to still slide laterally relative to both the inner wall portion of the door and the first dairy compartment member, while also enabling the second dairy compartment member to be simultaneously detached from the refrigerator door with the first dairy compartment member.

Additional features and advantages of the present invention will become more readily apparent from the following detailed description of the preferred embodiments thereof when taken in conjunction with the drawings wherein like reference numerals refer to corresponding parts in the several views.

BRIEF DESCRIPTION OF THE DRAWINGS

FIG. 4 is a perspective view of a refrigerator dairy compartment assembly constructed in accordance with a second embodiment of the invention;

FIG. 5 is a perspective view of a dairy compartment divider member incorporated in the dairy compartment assembly of FIG. 4; and FIG. 6 is a cross-sectional view generally taken along line VI—VI of FIG. 4.

DETAILED DESCRIPTION OF THE PREFERRED EMBODIMENTS

Figure 1:
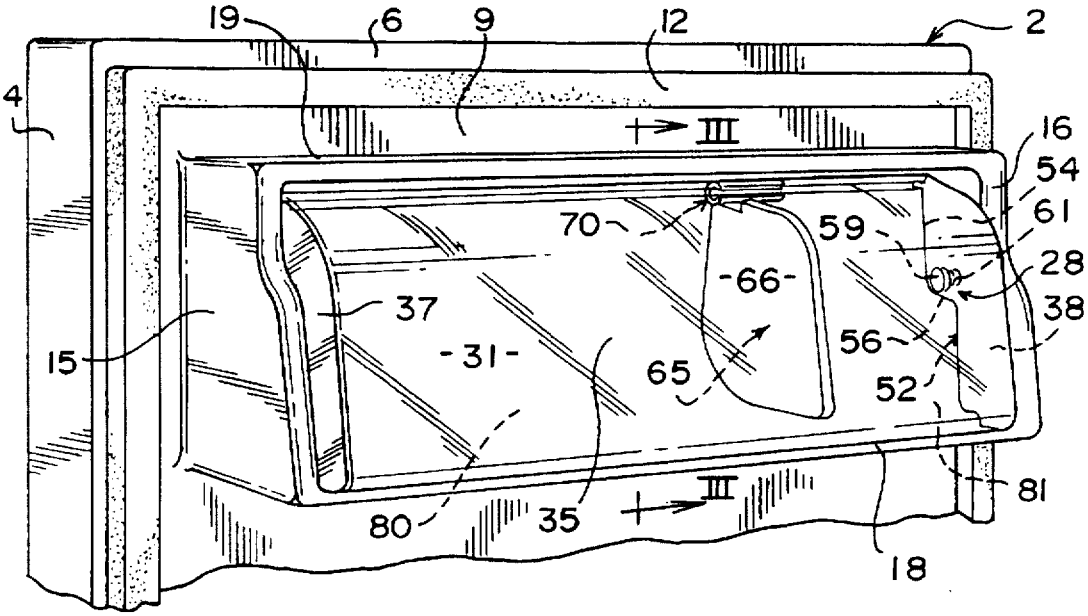
FIG. 1 is a perspective view of a portion of a refrigerator fresh food compartment door incorporating a dairy compartment assembly constructed in accordance with a first embodiment of the invention.
Figure 3:
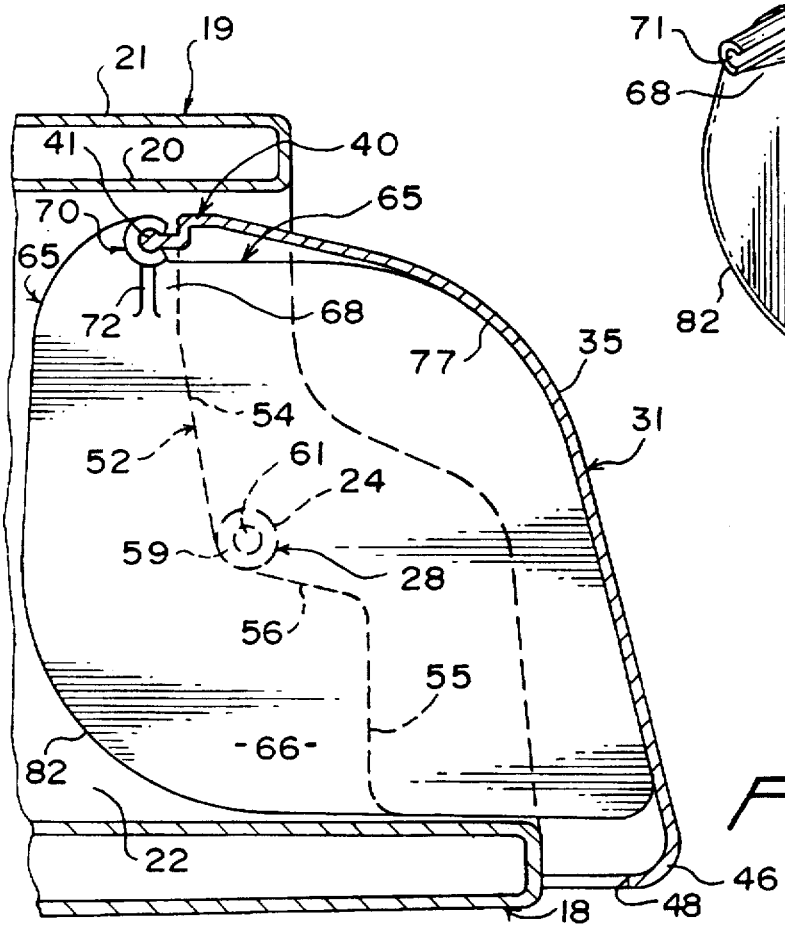
FIG. 3 is a cross-sectional view generally taken along line III—III of FIG. 1.

With initial reference to FIG. 1, a refrigerator fresh food door is generally indicated at 2 and includes an outer panel 4, preferably made from sheet metal, that defines an inner annular face portion 6 to which is attached a liner 9. The liner 9 is preferably integrally molded of plastic in a manner known in the art. An annular gasket 12 extends over the attachment zone between face portion 6 and liner 9 and is adapted to be sealed against a cabinet shell (not shown) of a refrigerator to seal off the fresh food compartment. At this point, it should be realized that this construction for fresh food door 2 is typical for various types of refrigerators, including side-by-side and top mount styles. In accordance with the preferred embodiment shown, liner 9 is integrally formed with a pair of laterally spaced dikes 15, 16, a shelf base 18 and a top 19. Each of the dikes 15, 16, shelf base 18 and top 19 are defined by inner and outer molded wall portions, as exemplified by inner and outer wall portions 20 and 21 of top 19 as shown in FIG. 3. Collectively, dikes 15, 16, shelf base 18 and top 19 form a storage compartment 22 with an inner wall portion (not separately labeled) of refrigerator fresh food door 2. Storage compartment 22 is adapted to house various food items, particularly dairy products.

The inner wall portions of dikes 15 and 16 are formed with respective apertures (one of which is indicated in FIG. 3 at 24) into which extend respective projections 28 of a cover/closure member 31. As best shown in FIGS. 1 and 3, closure member 31 has an arcuate front portion 35 and side walls 37 and 38. In the preferred embodiment, closure member 31 is integrally molded of plastic. The upper rear end 40 of closure member 31 terminates in a rearwardly extending, elongated knob portion 41. The lower front end of closure member 31 includes an integrally curved portion 46 that is formed with one or more elongated slots 48. Slots 48 are adapted to enable an individual to engage closure member 31 with his/her fingertips in order to pivot closure member 31 between a first, closed position, wherein access to food items placed within storage compartment 22 is not permitted but also wherein closure member 31 prevents the items from being undesirably displaced from within the storage compartment 22, and a second position, wherein direct access to the food items is available, as will be more fully discussed below.

Each of the side walls 37 and 38 of closure member 31 defines a rear edge, generally indicated at 52 in FIG. 3, that includes a generally vertically extending upper edge portion 54, a generally vertically extending lower edge portion 55 and a downwardly sloping, intermediate edge portion 56. At the outer juncture of vertically extending upper edge portion 54 and intermediate edge portion 56, at each side wall 37, 38 of closure member 31, is formed a respective one of the projections 28. More specifically, each projection 28 preferably includes an enlarged head 59 and a laterally outwardly extending shaft 61. In the preferred embodiment, projections 28 are integrally formed as part of closure member 31, however, it should be readily understood that the projections 28 could be separately formed wherein the head 59 of a respective projection 28 would be adhesively or otherwise attached to one of side walls 37 and 38.

In any event, with shafts 61 projecting laterally outwardly of side walls 37 and 38, shafts 61 can be received within the respective apertures 24 formed in dikes 15, 16 such that the shafts 61 define a substantially horizontally extending axis about which closure member 31 can pivot relative to dikes 15, 16, shelf base 18 and top 19. Therefore, closure member 31 aids in defining storage compartment 22 and generally constitutes a first dairy compartment member in accordance with the present invention. Again, closure member 31 can be pivoted about the axis defined by shafts 61 by a user inserting fingers through one or more slots 48 to rotate closure member 31 from the position shown in FIG. 3 to a position wherein arcuate front portion 35 generally extends along top 19, as well as along a section directly adjacent the inner wall of refrigerator fresh food door 2.

Figure 2:
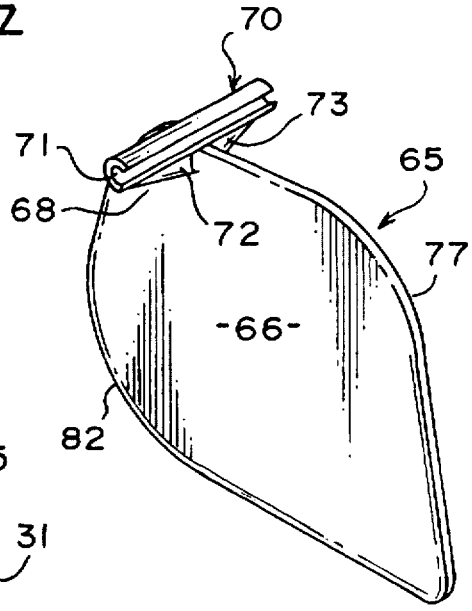
FIG. 2 is a perspective view of a dairy compartment divider member incorporated in the dairy compartment assembly of FIG. 1.

A second dairy compartment member that forms part of the refrigerator dairy compartment assembly of the invention is constituted by a divider element generally indicated at 65 in FIGS. 1–3. Divider element 65 has a body portion 66 that generally takes the form of a plate having an upper rear portion 68 from which projects a laterally extending, elongated socket defining member 70. As clearly shown in FIGS. 2 and 3, socket defining member 70 is generally C-shaped in side-view and defines an internal cavity 71. In the preferred embodiment, socket defining member 70 is preferably integrally formed of plastic with body portion 66 of divider element 65 and is reinforced by means of opposing lateral gussets 72 and 73. Although body portion 66 could take various forms including a solid member, it is preferably molded as a double-walled part that is open along its bottom and a lower section of its rear side (not shown).

Divider element 65 is adapted to be attached to closure member 31 for relative sliding movement. More specifically, socket defining member 70 is adapted to be snap-fit on knob portion 41. Since knob portion 41 extends substantially the entire distance between side walls 37 and 38 of closure member 31, divider element 65 can be readily shifted laterally, in either direction, such that storage compartment 22 is actually separated in varying volume storage zones 80 and 81 by means of divider element 65. In accordance with the preferred embodiment, divider element 65 includes a front peripheral edge 77 that conforms to the shape of arcuate front portion 35 of closure member 31 as clearly shown in FIG. 3. Since divider element 65 is connected to closure member 31, divider element 65 pivots in unison with closure member 31. To provide suitable clearance for this movement, divider element 65 is preferably provided with a rounded lower edge portion 82. Therefore, with this arrangement, divider element 65 is connected to liner 9 of refrigerator fresh food door 2 through closure member 31 and is movable relative to liner 9 in unison with closure member 31. In addition, divider element 65 can be shifted relative to both liner 9 and closure member 31. With divider element 65 aiding in defining the variable volume storage zones 80 and 81 and closure member 31 generally functioning as a door for storage compartment 22, closure member 31 and divider element 65 cooperate with dikes 15 and 16, shelf base 18 and top 19 to define an overall dairy compartment for refrigerator fresh food door 2.

FIGS. 4–6 illustrate a second dairy compartment embodiment constructed in accordance with the present invention wherein the dairy compartment is generally defined by a pick-off shelf or bucket. First of all, it should be understood that the structure of this second embodiment is also intended to be used on a refrigerator fresh food door 2 having a liner 9 and, at least, laterally spaced dikes 15 and 16. However, the dairy compartment constructed in accordance with this embodiment is adapted to be selectively, removably attached to the liner as will become more fully evident below. As shown in these Figures, the second embodiment incorporates a base 85 that is integrally formed with upstanding lateral side walls 87 and 88 and a rear wall 91 that extends forward to define a top section 93. Base 85 is formed with lower attachment structure, generally indicated at 95, which aids in defining a receiving area 96 located just forward of attachment structure 95. Attachment structure 95 and receiving area 96 are adapted to cooperate with finger members (not shown) which are integrally molded with the liner dikes in order to support base 85 upon door 2. More specifically, the finger members are adapted to engage attachment structure 95 and extend into receiving area 96 at both ends of support base 85 to selectively retain the entire dairy compartment assembly in a desired position upon door 2. Since the forming of such finger members on refrigerator liner dikes to removably support pick-off shelves or buckets is widely known in the art and does not form part of the present invention, it will not be further discussed in detail herein. In any event, providing a removable dairy compartment assembly can be convenient and adds to the overall versatility of the refrigerator's storage features. In addition, with this arrangement, base 85 can be sized to accommodate large dairy or other items thereon. In the preferred embodiment, base 85, side walls 87 and 88, rear wall 91 and top section 93 are integrally formed of plastic. In addition, side walls 87 and 88, as well as rear wall 91, preferably extend upward from a position spaced from an outer periphery of base 85 such that an annular ledge 97 is defined about base 85. At a front portion of base 85, annular ledge 97 defines an upwardly sloping section 99 as best shown in FIG. 6. In a manner similar to the construction of closure member 31 in the first embodiment described, side walls 87 and 88 each has extending outwardly therefrom a respective shaft 100, 101 which has associated therewith a respective enlarged head portion 102, 103.

In accordance with this second preferred embodiment, top section 93 includes a terminal mounting section 105 that extends from adjacent side wall 87 to adjacent side wall 88 as clearly shown in FIG. 4. Mounting section 105 includes a terminal upstanding edge 107 on the side of rear wall 91 as best shown in FIG. 6. This second dairy compartment embodiment is also provided with a divider element 112 having a body portion 113 in the form of a plate that is integrally formed with an upper clip member 115. As with divider element 65, divider element 112 preferably has a dual-walled construction and is open along bottom and rear portions thereof. Clip member 115 is defined by a pair of spaced, laterally extending legs 118 and 119 that are joined by a connecting section 121. A terminal end of leg 118 is provided with a down-turned lip 123 as best shown in FIGS. 5 and 6. Between legs 118 and 119 is defined a socket or cavity 125 that is adapted to receive mounting section 105 with down-turned lip 123 extending over upstanding edge 107 as clearly shown in FIG. 6. Specifically, clip member 115 is adapted to be pushed onto mounting section 105 with socket 125 initially expanding in size until lip 123 reaches edge 107, at which time, clip member 115 snaps down into the position shown in FIG. 6.

Although firmly attached, divider element 112 is permitted to shift laterally relative to base 85 such that varying volume storage zones (not separately labeled) are defined on either side of divider element 112, between divider element 112 and side walls 87 and 88 respectively. Therefore, in accordance with this second embodiment, the entire dairy compartment assembly is connected to liner 9 for movement relative thereto, i.e., can be selectively inserted between dikes 15 and 16 or removed as a unit therefrom, and divider element 112 is mounted for movement relative to both the liner 9 and base 85. In other words, in a manner analogous to the first embodiment described, base 85, upstanding side walls 87 and 88, rear wall 91 and top section 93 define a first dairy compartment member and divider element 112 defines a second dairy compartment member. Both of these dairy compartment members are movably mounted with respect to the liner 9 of refrigerator fresh food door 2 and divider element 112 is laterally slidable relative to both liner 9 and the first dairy compartment member.

Annular ledge 97 is effectively incorporated to enable the dairy compartment assembly in accordance with the second embodiment described above to be used in combination with a pivotable cover/closure member 135 which is analogous to member 31 described above. As generally illustrated in FIGS. 4 and 6, the cover/closure member 135 includes apertures 138 which receive shafts 100 and 101 to enable pivotal movement of cover/closure member 135 relative to base 85, side walls 87 and 88, rear wall 91 and top section 93. In this embodiment, the side walls of cover/closure member 135 are adapted to be positioned between the door dikes and side walls 87 and 88. In addition, cover/closure member 135 is removable from liner 9 as a unit with the structure of FIGS. 4–6. However, it should be realized that the embodiment of FIGS. 4–6 can be advantageously used without cover/closure member 135, particularly given the fact that upwardly sloping section 99 and divider element 112 will function to limit the shifting of food items placed upon base 85, even if the food items are jarred when refrigerator fresh food door 2 is opened and closed. In any event, it should simply be readily apparent that the dairy compartment assembly of the present invention can take various forms, such as the embodiments described above, and can be effectively utilized in various ways and with numerous styles of refrigerators.

Therefore, based on the above, it should be readily apparent that various changes and/or modifications can be made to the present invention without departing from the spirit thereof. In general, the invention is only intended to be limited by the scope of the following claims.

We claim:

1. In a refrigerator door including an inner wall portion adapted to form part of a fresh food compartment for a refrigerator, a dairy compartment assembly comprising:

a first dairy compartment member connected to the inner wall portion of said refrigerator door but being movable relative to said inner wall portion; and a second dairy compartment member slidably attached to said first dairy compartment member for movement relative to both said inner wall portion and said first dairy compartment member, said first and second dairy compartment members defining portions of a dairy compartment arranged on the inner wall portion of said refrigerator door.

2. The dairy compartment assembly according to claim 1, wherein said second dairy compartment member comprises a divider element for separating the dairy compartment into varying volume storage zones.

3. The dairy compartment assembly according to claim 2, wherein said dividing element has a peripheral contour that conforms to a cross-section shape of said first dairy compartment member.

4. The dairy compartment assembly according to claim 2, wherein one of said first and second dairy compartment members is formed with an elongated socket portion and another of said first and second dairy compartment members includes a body section received in said elongated socket portion for slidably attaching said second dairy compartment member to said first dairy compartment member.

5. The dairy compartment assembly according to claim 4, wherein said body section of said another of said first and second dairy compartment members constitutes an elongated knob portion, said knob portion being received within said socket portion to attach said second dairy compartment member to said first dairy compartment member.

6. The dairy compartment assembly according to claim 5, wherein said first dairy compartment member is formed with said knob portion and said second dairy compartment member is formed with said socket portion.

7. The dairy compartment assembly according to claim 4, wherein said another of said first and second dairy compartment members includes a body section including an elongated, upstanding terminal edge which is received within said socket portion.

8. The dairy compartment assembly according to claim 2, wherein said inner wall portion is constituted by a refrigerator door liner that is formed with a pair of spaced, outwardly projecting dike portions, said first dairy compartment member being movably connected to each of said dike portions.

9. The dairy compartment assembly according to claim 8, wherein said dike portions include opposing apertures and said first dairy compartment member includes a pair of outwardly extending, spaced projections which are received in the apertures of said dike portions.

10. The dairy compartment assembly according to claim 9, wherein said first dairy compartment member is pivotally connected to the dike portions of said refrigerator door liner about an axis defined by said projections.

11. The dairy compartment assembly according to claim 8, wherein said first dairy compartment member is selectively, removably connected between said dike portions.

12. The dairy compartment assembly according to claim 11, further comprising a cover member pivotally attached to said first dairy compartment member.

13. In a refrigerator door including an inner wall portion adapted to form part of a fresh food compartment for a refrigerator, a dairy compartment assembly comprising:

a first dairy compartment member connected to the inner wall portion of said refrigerator door but being movable relative to said inner wall portion; and a second dairy compartment member attached to said first dairy compartment member for movement in unison with said first dairy compartment member relative to said inner wall portion, said second dairy compartment member also being movable relative to said first dairy compartment member, said first and second dairy compartment members defining portions of a dairy compartment arranged on the inner wall portion of said refrigerator door.

14. The dairy compartment assembly according to claim 13, wherein said second dairy compartment member comprises a divider element for separating the dairy compartment into varying volume storage zones.

15. The dairy compartment assembly according to claim 14, wherein said dividing element has a peripheral contour that conforms to a cross-section shape of said first dairy compartment member.

16. The dairy compartment assembly according to claim 14, wherein said first dairy compartment member is pivotally connected to the inner wall portion of said refrigerator door.

17. The dairy compartment assembly according to claim 14, wherein one of said first and second dairy compartment members is formed with an elongated socket portion and another of said first and second dairy compartment members includes a body section received in said elongated socket portion, said socket and body portions being relatively slidable such that said second dairy compartment member is slidably attached to said first dairy compartment member.

18. The dairy compartment assembly according to claim 14, wherein said inner wall portion is constituted by a refrigerator door liner that is formed with a pair of spaced, outwardly projecting dike portions, said first dairy compartment member being attached to each of said dike portions.

19. The dairy compartment assembly according to claim 18, wherein said first dairy compartment member is pivotably connected to said dike portions.

20. The dairy compartment assembly according to claim 18, wherein said first dairy compartment member is selectively, removably connected between said dike portions.

* * * * *